US005290977A

United States Patent [19]

Huang

[11] Patent Number: 5,290,977

[45] Date of Patent: Mar. 1, 1994

[54] DATA TRANSFER SWITCH

[76] Inventor: Hobbes Huang, 7F, No. 4, Lane 31, Chung-Hsing Rd., Hsi-Chih Chen, Taipei Hsien, Taiwan

[21] Appl. No.: 961,747

[22] Filed: Oct. 16, 1992

[51] Int. Cl.[5] ..... H01H 19/58; H01H 21/78

[52] U.S. Cl. ..... 200/14; 200/110

[58] Field of Search ..... 200/5 R, 11 R, 11 A, 200/11 D, 11 DA, 11 TC, 11 TW, 14, 17 R, 18, 24

[56] References Cited

U.S. PATENT DOCUMENTS 2,811,594 10/1957 Papouschek ..... 200/14

2,988,607 6/1961 Tabet ..... 200/11

*Primary Examiner*—A. D. Pellinen

*Assistant Examiner*—Michael A. Friedhofer

*Attorney, Agent, or Firm*—Townsend and Townsend Khourie and Crew

[57] ABSTRACT

A data transfer switch has a casing and a linking unit which is rotatably provided inside the casing and which includes a plurality of interconnected linking pieces. Each of the linking pieces is a relatively thin cylindrical insulator and has one side which is provided with an axial tubular projection that extends toward an adjacent one of the linking pieces so as to form an annular groove between each of the linking pieces and the adjacent one of the linking pieces. A plurality of connector pin sets are mounted on a side wall of the casing. Each of the connector pin sets has a plurality of connector pins which respectively extend into a corresponding annular groove of the linking unit. A conductive pattern is provided on each of the linking pieces at each annular groove. Rotation of the linking unit from a first angular position to a second angular position causes the conductive pattern to break electrical connection between a first one of the connector pins sets and a second one of the connector pin sets and make electrical connection between the first one of the connector pin sets and a third one of the connector pin sets.

10 Claims, 8 Drawing Sheets

DATA TRANSFER SWITCH

BACKGROUND OF THE INVENTION

1. Field of the Invention

The invention relates to a data transfer switch, more particularly to a data transfer switch which is relatively simple in construction, which is relatively small and which can be used to connect selectively a plurality of computer peripheral equipments to a computer system.

2. Description of the Related Art

Data transfer switches are used to connect a plurality of computer peripheral equipments to a single computer system.

Referring to FIG. 1, a first example of a conventional data transfer switch (1) is shown to comprise a printed circuit board (11), three connectors (12, 13, 14) which are mounted on the printed circuit board (11) and two sets of key-operated switches (15, 16). Each of the key-operated switch sets (15, 16) includes three switch units [(151-153), (161-163)] and a key body (154, 164). A spring assembly [(155-157), (165-167)] is provided between the key body (154, 164) and each of the switch units [(151-153), (161-163)]. The spring assemblies [(155-157), (165-167)] permit a previously pressed one of the key bodies (154, 164) to revert to an unpressed state when the other one of the key bodies (154, 164) is pressed.

When the key body (154) is pressed, the switch units (151-153) are activated so as to connect electrically the connectors (12, 13). Accordingly, when the key body (164) is pressed, the switch units (161-163) are activated so as to connect electrically the connectors (13, 14). The connector (13) therefore serves as a common connector. The key bodies (154, 164) are operated so as to transfer data from a selected one of the connectors (12, 14) to the common connector (13) or so as to transfer data from the common connector (13) to a selected one of the connectors (12, 14).

The main drawbacks of the conventional data transfer switch (1) are as follows:

1. The size of the data transfer switch (1) is relatively large.

2. The circuitry of the data transfer switch (1) is relatively complicated.

3. The data transfer switch (1) can be used to connect selectively only two connectors (12, 14) to a common connector (13).

Referring to FIG. 2, a second example of a conventional data transfer switch (2) is shown to be substantially similar in construction to the data transfer switch (1). The main difference between the two examples is that the data transfer switch (2) incorporates a two-position select switch (21). The key body (211) of the select switch (21) is operated once in order to connect electrically the connectors (22, 23) and is operated for a second time in order to connect electrically the connectors (23, 24). Note that the size of the data transfer switch (2) is smaller than that of the data transfer switch (1) because a different switching arrangement is employed. However, the circuitry of the data transfer switch (2) is still relatively complicated. Furthermore, the data transfer switch (2) can be used to connect selectively only two connectors (22, 24) to the common connector (23).

A more complicated circuitry and switch arrangement is usually required in order to enable a data transfer switch to connect selectively more than two connectors to a common connector. Referring to FIG. 3, a third example of a conventional data transfer switch (3) includes a four-position switch set (31), five connectors (32-36) and five ribbon cables (321-326) respectively connected to the connectors (32-36). The switch set (31) is mounted on a printed circuit board (311) and includes five switch units (312-316). Each of the switch units (312-316) has a control lever which extends through a respective one of five openings (3121-3161) that are formed in a switch actuator (317). The switch actuator (317) has a central portion that is provided with a rack (37). A rotary knob (39) has an axle (391) which is provided with a pinion (38) that engages the rack (37).

Rotation of the rotary knob (39) can cause corresponding rotation of the pinion (38), thereby moving the rack (37) so as to result in left or right movement of the switch actuator (317). Movement of the switch actuator (317) causes corresponding movement of the control levers of the switch units (312-316). Simultaneous operation of the switch units (312-316) causes the connection of a selected one of the connectors (32, 33, 35, 36) with the common connector (34) via the ribbon cables (321-361), thereby permitting the transfer of data from the selected one of the connectors (32, 33, 35, 36) to the common connector (34) or the transfer of data from the common connector (34) to the selected one of the connectors (32, 33, 35, 36).

Note that although the data transfer switch (3) permits the selective connection of four connectors (32, 33, 35, 36) to the common connector (34), the data transfer switch (3) has a more complicated circuitry and has a relatively large size.

Another example of a conventional data transfer switch which permits the selective connection of four connectors to a common connector is shown in FIG. 4. The data transfer switch (4) includes a plurality of linking assemblies (40) which serve as the main portion of the data transfer switch (4). Each of the linking assemblies (40) includes a pair of annular linking pieces (41, 42) and a rotary piece (43) provided between the linking pieces (41, 42). The linking piece (41) has three angularly spaced contact terminals provided on the outer periphery thereof and connected to the common connector (not shown). The linking piece (41) further has three inwardly projecting sectoral electrical contacts (411) which are connected electrically to a respective one of the contact terminals of the linking piece (41). The linking piece (42) has twelve angularly spaced contact terminals provided on the outer periphery thereof and alternately connected to four connectors (not shown). The linking piece (42) further has twelve inwardly projecting sectoral electrical contacts (421) which are connected electrically to a respective one of the contact terminals of the linking piece (42). The rotary piece (43) is formed with twelve radially extending slits (44). Three conductive spring pieces (45) are respectively provided in three of the slits (44) such that the spring pieces (45) are angularly and equally spaced on the rotary piece (43). A rotary knob (46) is operated so as to rotate the rotary piece (43), thereby causing the spring pieces (45) to connect the three electrical contacts (411) with a selected three of the electrical contacts (421).

Cables are soldered onto the contact terminals of the linking pieces (41, 42) and are used to connect the latter to the corresponding connectors. If 25-pin connectors are in use, nine linking assemblies (40) must be provided in order to permit the selective connection of four connectors to a common connector.

The data transfer switch (4) has several drawbacks. Note that the construction of the data transfer switch (4) is relatively complicated because of the large number of cables which is required. The data transfer switch (4) is difficult to assemble because each of the cables has to be connected to one of the contact terminals of the linking pieces (41, 42) and to one of the connectors. Improper connection of the cables can result in data loss. Furthermore, the cables can introduce a relatively large impedance into the system and can cause the generation of heat when the data transfer switch (4) is in use, thereby increasing the possibility of data loss.

Still another example of a conventional data transfer switch is shown in FIG. 5. The data transfer switch (5) is substantially similar to the data transfer switch (4), except that the cables of the latter are replaced by a printed circuit board. Although the data transfer switches (4, 5) permit the selective connection of more than two connectors to a common connector, the data transfer switches (4, 5) are relatively complicated in construction because of the large number of electrical contacts which is required (typically a multiple of the number of connectors that are available). The data transfer switches (4, 5) are thus difficult to manufacture. Furthermore, because of the complexity of the data transfer switches (4, 5), it would be difficult to troubleshoot the same in order to find the cause of a malfunction.

SUMMARY OF THE INVENTION

Therefore, the objective of the present invention is to provide a data transfer switch which is relatively simple in construction, which is relatively small and which can be used to connect selectively a plurality of computer peripheral equipments to a computer system.

Accordingly, the preferred embodiment of a data transfer switch of the present invention comprises:

a casing including a front casing part, a rear casing part and a side wall interconnecting the front and rear casing parts;

a linking unit rotatably provided inside the casing and including a plurality of interconnected linking pieces, each of the linking pieces being a relatively thin cylindrical insulator and having one side provided with an axial tubular projection which extends toward an adjacent one of the linking pieces so as to form an annular groove between each of the linking pieces and the adjacent one of the linking pieces;

a plurality of connector pin sets mounted on the side wall of the casing, each of the connector pin sets having a plurality of connector pins which respectively extend into a corresponding annular groove of the linking unit; and a conductive pattern provided on each of the linking pieces at each annular groove, rotation of the linking unit from a first angular position to a second angular position causing the conductive pattern to break electrical connection between a first one of the connector pins sets and a second one of the connector pin sets and make electrical connection between the first one of the connector pin sets and a third one of the connector pin sets.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
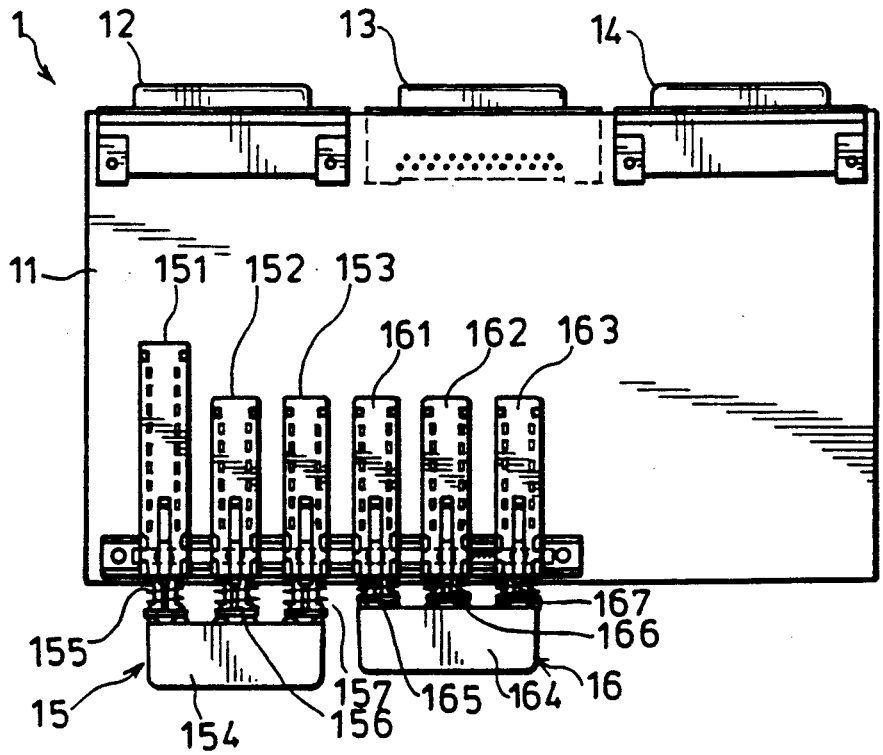
FIG.1 PRIOR ART
FIG. 1 is an illustration of a first example of a conventional data transfer switch.
Figure 2:
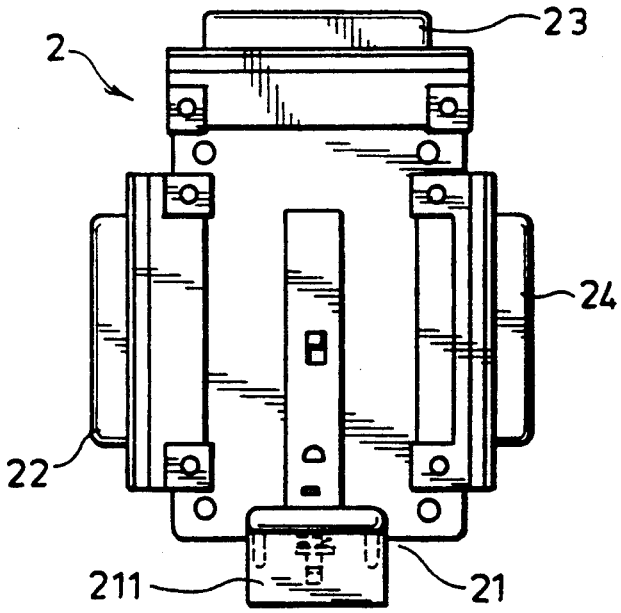
FIG.2 PRIOR ART
FIG. 2 is an illustration of a second example of a conventional data transfer switch.
Figure 3:
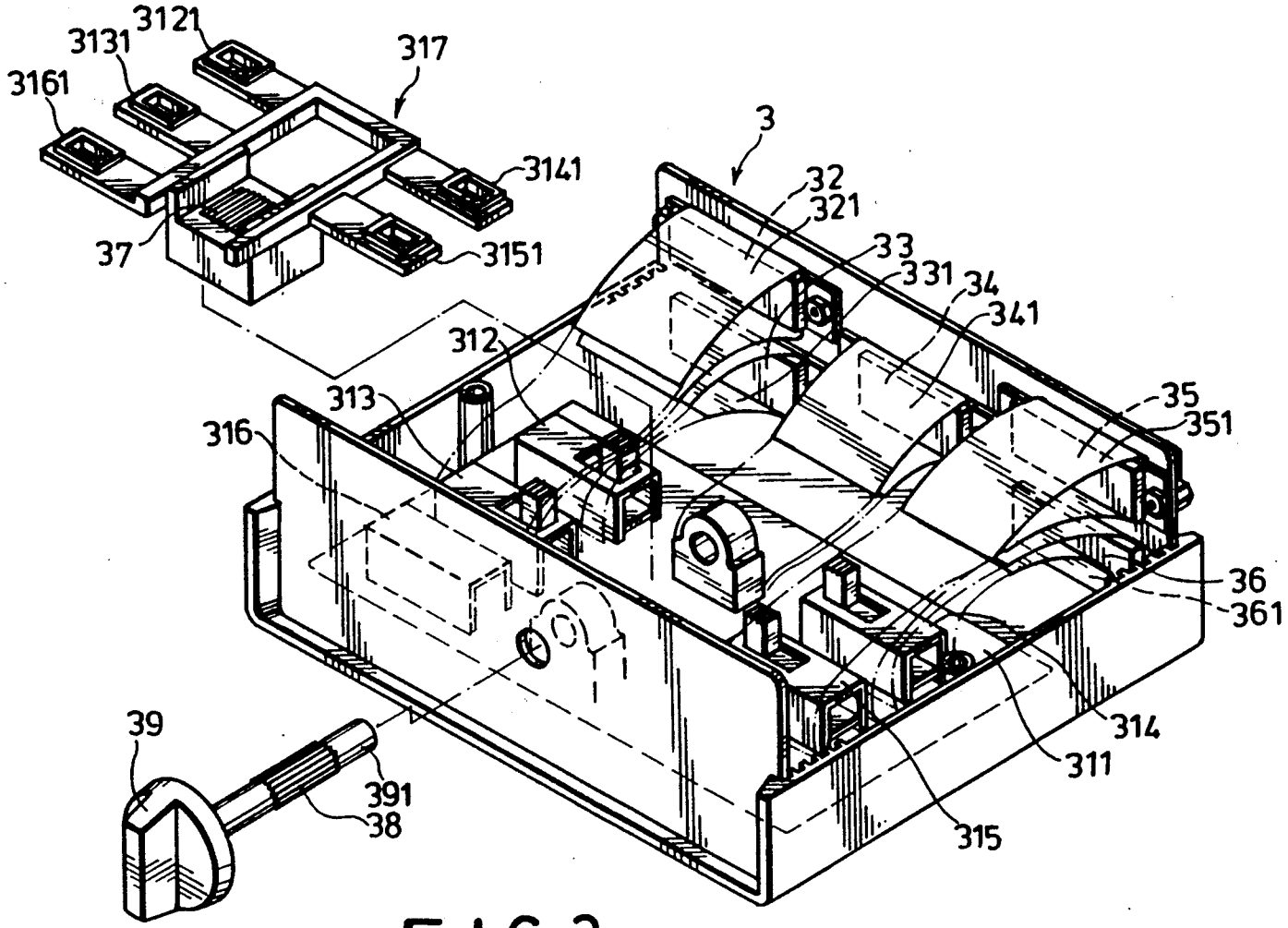
FIG. 3 PRIOR ART
FIG. 3 is an illustration of a third example of a conventional data transfer switch.
Figure 4:
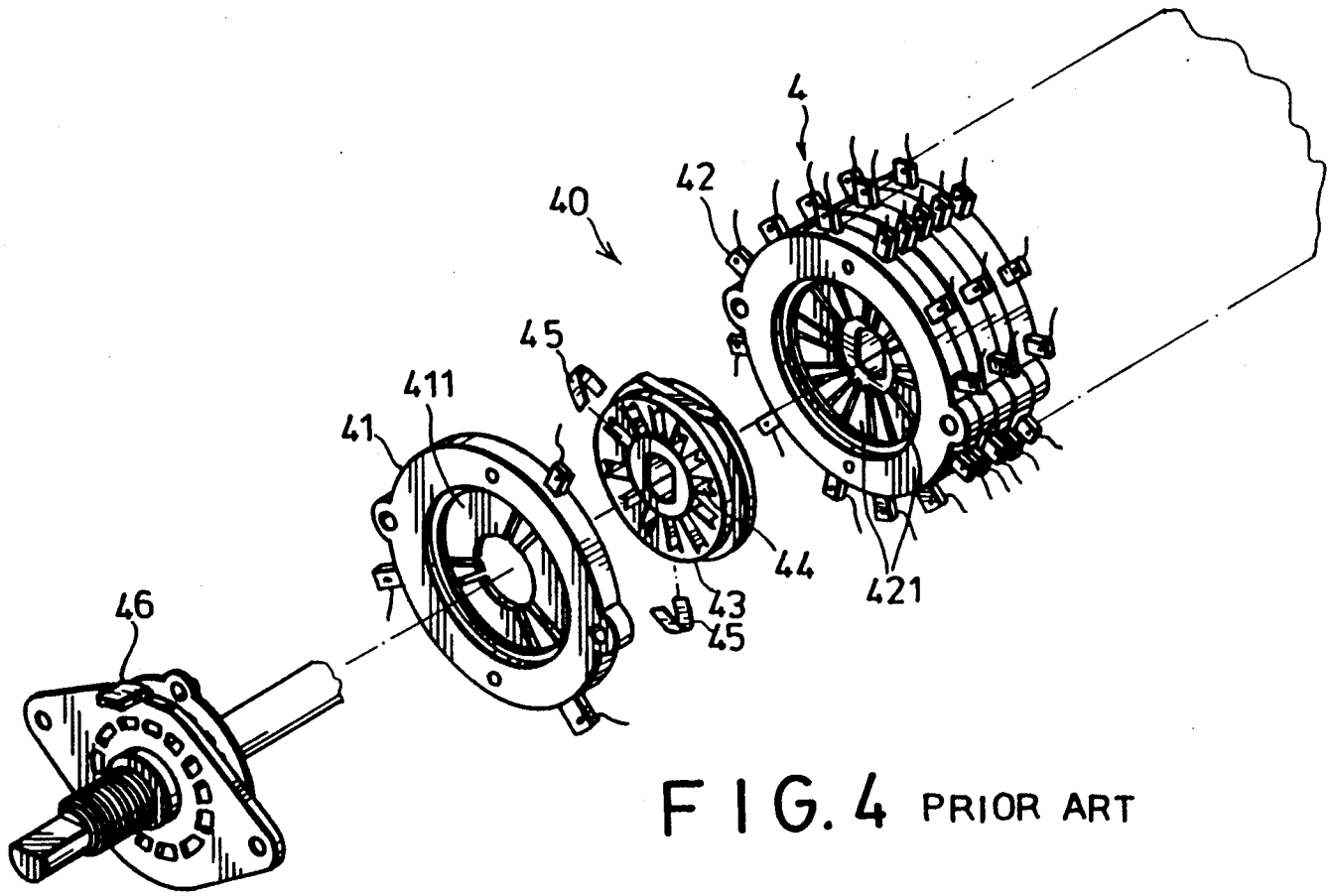
FIG. 4 PRIOR ART
FIG. 4 is an illustration of a fourth example of a conventional data transfer switch.
Figure 5:
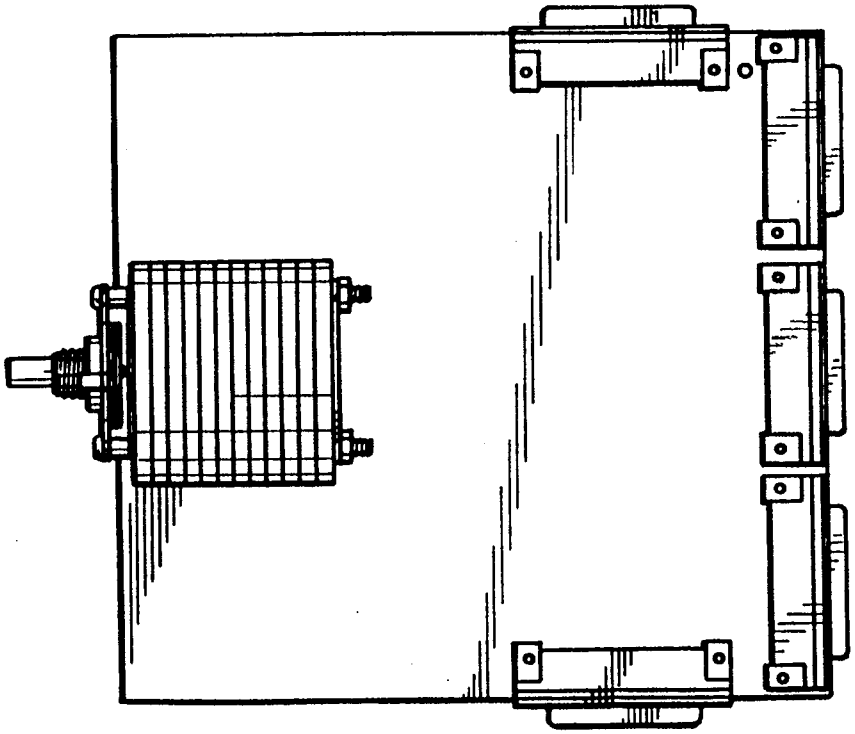
FIG. 5 PRIOR ART
FIG. 5 is an illustration of a fifth example of a conventional data transfer switch.
Figure 6:
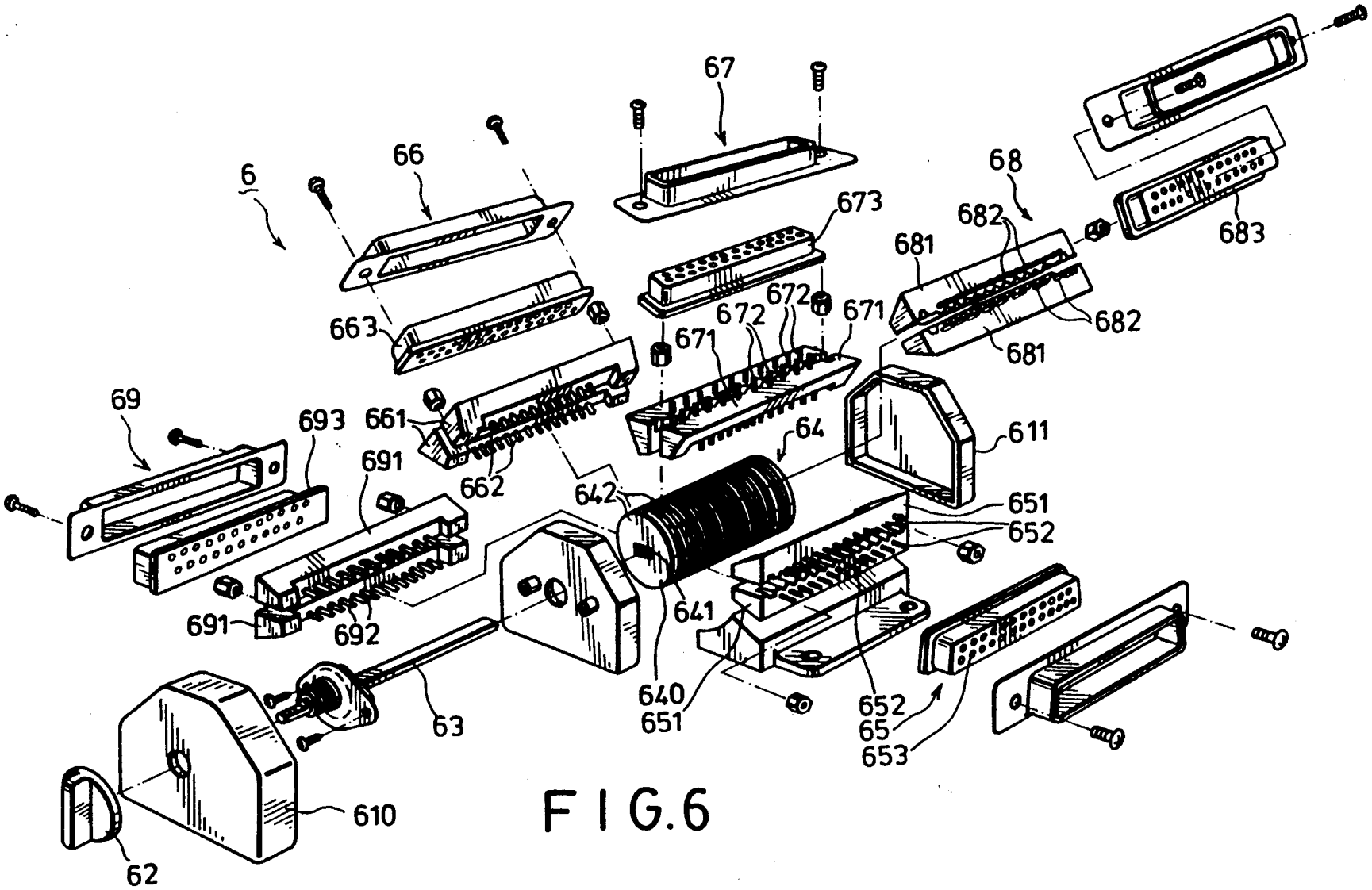
FIG. 6 is an exploded view of the first preferred embodiment of a data transfer switch according to the present invention.

Referring to FIG. 6, the first preferred embodiment of a data transfer switch (6) according to the present invention is shown to comprise front and rear casing parts (610, 611), a rotary knob (62), a drive shaft (63), a linking unit (64) and five connectors (65–69).

The connectors (65–69) are mounted on a side wall which interconnects the front and rear casing parts (610, 611). Each of the connectors (65–69) includes two sets of connector pins (652–692), each set of connector pins (652–692) being secured to a mounting seat (651–691) which is made of an insulative material, and a socket frame (653–693) secured to the side wall of the front and rear casing parts (610, 611).

The drive shaft (63) has a front end which is rotatably secured to the front casing part (610). The front end of the drive shaft (63) extends outward through the front casing part (610) and is connected to the rotary knob (62). The linking unit (64) includes a plurality of interconnected linking pieces (640). Each of the linking pieces (640) is a relatively thin cylindrical insulator which is provided with an axial rectangular bore (641). The drive shaft (63) is rectangular in cross-section and extends into the rectangular bore (641). Rotation of the rotary knob (62) can thus cause corresponding rotation of the linking unit (64). Each linking piece (640) confines an annular groove (642) with an adjacent linking piece (640). Each linking piece (640) is further provided with a conductive pattern (not shown) on one side. Each of the connector pins of the connector pin sets (652–692) extends into a corresponding one of the annular grooves (642). The linking unit (64) is rotated so as to permit the conductive patterns on the linking pieces (640) to connect one of the connector pin sets (652–692) with a selected one of the remaining connector pin sets (652–692).

Figure 7:
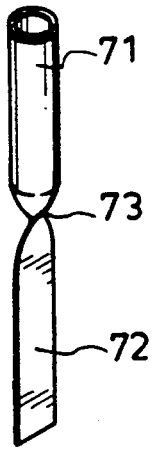
FIG. 7 is a perspective view of a connector pin of the first preferred embodiment.
Figure 9:
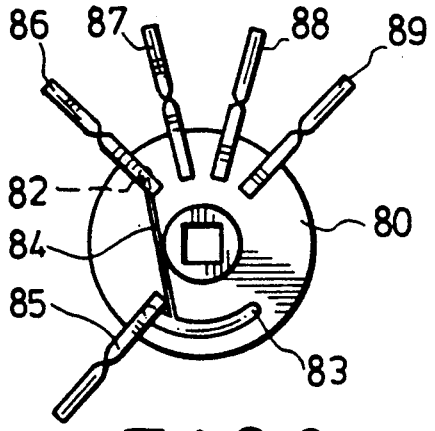
FIGS. 9 to 12 illustrate the first preferred embodiment under different operating positions.

A connector pin of the connector pin sets (652–692) is shown in FIG. 7. The connector pin has a flat contact portion (72) which extends into one of the annular grooves (642) of the linking unit (64) so as to achieve proper electrical contact with a corresponding one of the conductive patterns. The connector pin further has a tubular part (71) which extends from the upper end of the flat contact portion (72) and is mounted on a respective one of the mounting seats (651–691). The tubular part (71) of the connector pin extends into the socket frame (653–693), thereby enabling the connectors (65–69) to serve as a socket connector. The connector pin further has a twisted neck (73) which joins the tubular part (71) and the flat contact portion (72). The neck (73) is formed by twisting the upper end of the flat contact portion (72) by a 90° angle, thereby enhancing the elasticity of the contact portion (72) so as to achieve proper electrical contact with the corresponding conductive pattern.

Figure 8:
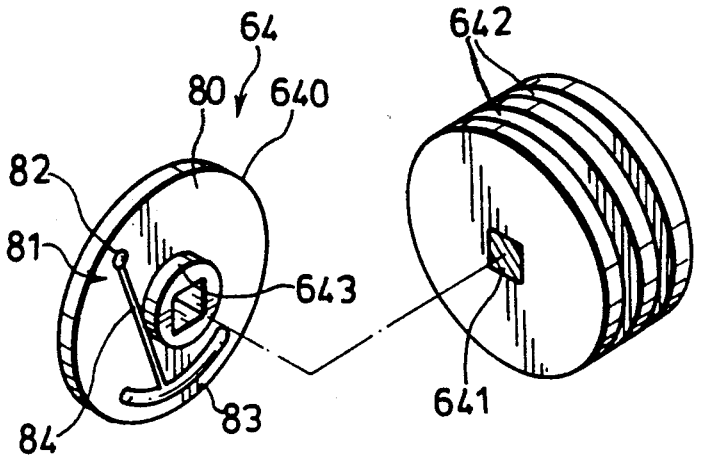
FIG. 8 illustrates a conductive pattern which is formed on a linking unit of the first preferred embodiment.

Referring to FIG. 8, each of the linking pieces (640) has one side (80) which is provided with an axial tubular projection (643) that extends toward an adjacent linking piece (640) so as to form the annular groove (642). The conductive pattern (81) is formed on the side (80) of the linking piece (640) and includes a projecting conductive dot (82) on one part of the side (80), a projecting conductive arc (83) on an opposite part of the side (80) and a conductive strip (84) which connects the conductive dot (82) and the conductive arc (83).

Figure 10:
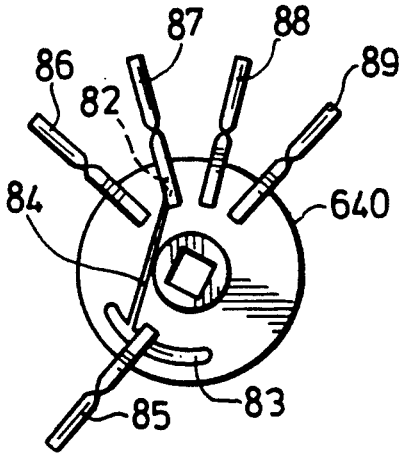
Figure 11:
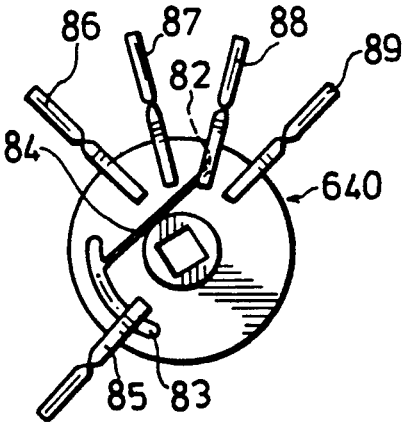
Figure 12:
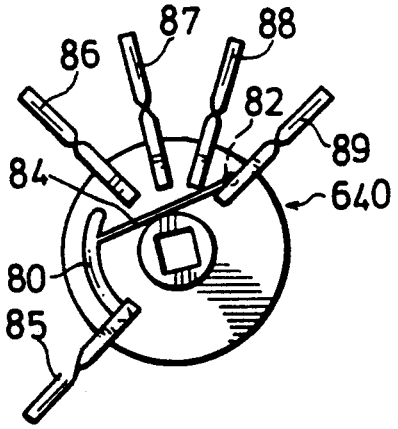

FIGS. 9 to 12 illustrate the first preferred embodiment under different operating stages. Pin (85) belongs to a common one of the connectors (65–69), while pins (86–89) respectively belong to one of the remaining connectors (65–69). Initially, the common connector is connected to a first one of the remaining connectors. Thus, the pin (86) is in contact with the conductive dot (82) while the pin (85) is in contact with the conductive arc (83). The rotary knob (62) is operated so as to rotate the linking unit (64) and cause the pin (87) to make contact with the conductive dot (82) while maintaining the pin (85) in contact with the conductive arc (83) when it is desired to connect the common connector to a second one of the remaining connectors, as shown in FIG. 10. Further operation of the rotary knob (62) causes the pin (88) or the pin (89) to make contact with the conductive dot (82) while maintaining the pin (85) in contact with the conductive arc (83), thereby connecting the common connector to a third or fourth one of the remaining connectors, as shown in FIGS. 11 and 12.

Note that the conductive strip (84) is designed so as to avoid contact with the pins (86–89) when the rotary knob (62) is operated. The movable range of the linking unit (64) is taken into consideration when determining the location and length of the conductive arc (83) of the conductive patterns (81). The conductive arc (83) should be in constant contact with the pin (85), regardless of the angular position of the linking unit (64). Movement of the linking unit (64) from one position to another causes the conductive dot (82) to break electrical connection with one of the pins (86–89) and achieve electrical connection with a succeeding one of the remaining pins (86–89).

The construction of the linking unit (64) is basically the same, regardless of the number of connectors available. The number of annular grooves (642) and conductive patterns (81), however, should correspond to the number of pins of the available connectors.

Figure 13:
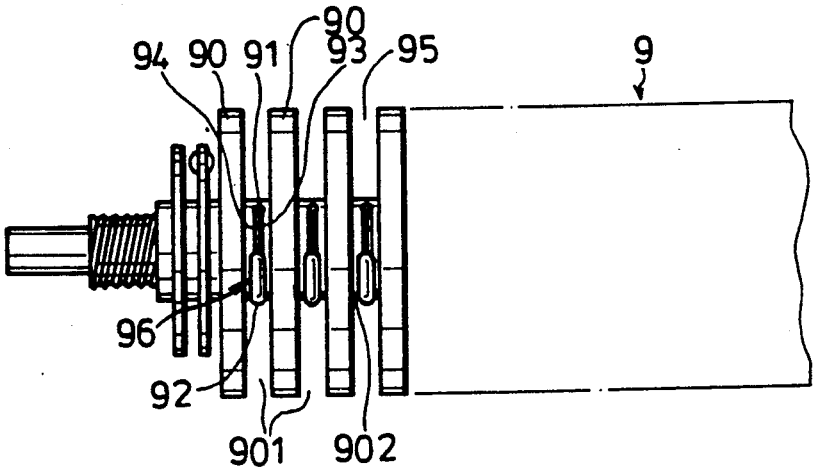
FIG. 13 is a schematic view of a linking unit of the second preferred embodiment of a data transfer switch according to the present invention.

FIG. 13 is a side view of the linking unit (9) of the second preferred embodiment of a data transfer switch according to the present invention. As with the first preferred embodiment, the linking unit (9) comprises a plurality of linking pieces (90) and has an annular groove (901) which is formed between two adjacent linking pieces (90). Each of the linking pieces (90) has one side which is provided with an axial tubular projection (902) that extends toward the adjacent linking piece (90) so as to form the annular groove (901). A conductive pattern (96) is formed on the peripheral side of the tubular projection (902) and includes a projecting conductive dot (91) and a projecting conductive arc (92). The peripheral side of the tubular projection (902) is further provided with a recess (93) which extends from the conductive dot (91) to the conductive arc (92). An electrical cable (94) is received in the recess (93) and connects electrically the conductive dot (91) and the conductive arc (92). The operation of the linking unit (9) is substantially similar to that of the linking unit (64) and will not be detailed further.

Figure 14:
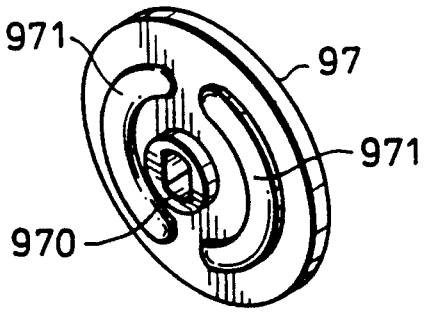
FIG. 14 is a perspective view of a linking piece of the third preferred embodiment of a data transfer switch according to the present invention.

FIG. 14 is a perspective view of a linking piece (97) of the linking unit of the third preferred embodiment of a data transfer switch according to the present invention. As with the first and second embodiments, the linking piece (97) is a relatively thin cylindrical insulator which is provided with an axial rectangular bore. The linking piece (97) has one side which is provided with an axial tubular projection (970) that extends toward an adjacent linking piece (97) so as to form an annular groove (not shown). The one side of the linking piece (97) is formed with a conductive pattern which includes a pair of oppositely projecting conductive arcs (971). The linking piece (97) is rotatable between a first position, wherein a first one of the conductive arcs (971) connects electrically a first connecting pin with a second connecting pin (not shown), and a second position, wherein a second one of the conductive arcs (971) connects electrically the first connecting pin with a third connecting pin (not shown).

The advantages and characterizing features of the data transfer switch of the present invention are as follows:

1. The data transfer switch does not require additional auxiliary circuits. The connector pins of the connectors are directly connected to the linking unit, and thus, little impedance is introduced. Little heat is generated when the data transfer switch is in use, thereby minimizing data loss and erroneous operation of the data transfer switch.

2. The data transfer switch has a relatively simple construction. The complexity of the data transfer switch does not depend upon the number of available connectors.

3. The data transfer switch is relatively small. The number of connectors which are available has a minimal effect on the size of the data transfer switch.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A data transfer switch, comprising:

a casing including a front casing part, a rear casing part and a side wall interconnecting the front and rear casing parts;

a linking unit rotatably provided inside said casing and including a plurality of interconnected linking pieces, each of said linking pieces being a relatively thin cylindrical insulator and having one side provided with an axial tubular projection which extends toward an adjacent one of said linking pieces so as to form an annular groove between each of said linking pieces and the adjacent one of said linking pieces;

a plurality of connector pin sets mounted on said side wall of said casing, each of said connector pin sets having a plurality of connector pins which respectively extend into a corresponding said annular groove of said linking unit; and a conductive pattern provided on each of said linking pieces at each said annular groove, rotation of said linking unit from a first angular position to a second angular position causing said conductive pattern to break electrical connection between a first one of said connector pins sets and a second one of said connector pin sets and make electrical connection between the first one of said connector pin sets and a third one of said connector pin sets.

2. The data transfer switch as claimed in claim 1, further comprising:

a drive shaft rotatably secured to said casing and having a first end which extends outward through said front casing part and a second end which extends into said casing and which engages axially said linking unit; and a rotary knob secured to said first end of said drive shaft and operable so as to rotate said drive shaft to cause corresponding rotation of said linking unit.

3. The data transfer switch as claimed in claim 1, wherein each of said connector pins comprises:

a flat contact portion which extends into the corresponding said annular groove so as to make or break electrical connection with a corresponding said conductive pattern in accordance with the angular position of said linking unit; and a tubular part which extends from an upper end of said flat contact portion and which is mounted on said side wall of said casing;

whereby, each of said connector pin sets forms a socket connector.

4. The data transfer switch as claimed in claim 3, wherein each of said connector pins further comprises a twisted neck which joins said tubular part and said flat contact portion so as to enhance elasticity of said contact portion in order to achieve proper electrical contact with the corresponding said conductive pattern.

5. The data transfer switch as claimed in claim 4, wherein said neck is formed by twisting the upper end of said flat contact portion by a 90° angle.

6. The data transfer switch as claimed in claim 1, wherein said conductive pattern is formed on said one side of each of said linking pieces and comprises:

a projecting conductive dot formed on one part of said one side of each of said linking pieces; and a projecting conductive arc formed on an opposite part of said one side of each of said linking pieces and electrically connected to said conductive dot;

whereby, said conductive arc is in constant electrical contact with a corresponding one of said connector pins of said first one of said connector pin sets, and said conductive dot makes electrical contact with a corresponding one of said connector pins of remaining ones of said connector pin sets in accordance with the angular position of said linking unit.

7. The data transfer switch as claimed in claim 6, wherein said conductive pattern further comprises a conductive strip which connects electrically said conductive dot and said conductive arc.

8. The data transfer switch as claimed in claim 1, wherein said tubular projection of each of said linking pieces has a peripheral side, said conductive pattern being formed on said peripheral side of said tubular projection of each of said linking pieces and comprises:

a projecting conductive dot formed on one part of said peripheral side of said tubular projection of each of said linking pieces; and a projecting conductive arc formed on an opposite part of said peripheral side of said tubular projection of each of said linking pieces and electrically connected to said conductive dot;

whereby, said conductive arc is in constant electrical contact with a corresponding one of said connector pins of said first one of said connector pin sets, and said conductive dot makes electrical contact with a corresponding one of said connector pins of remaining ones of said connector pin sets in accordance with the angular position of said linking unit.

9. The data transfer switch as claimed in claim 8, wherein:

said peripheral side of said tubular projection of each of said linking pieces is formed with a recess which extends from said conductive dot to said conductive arc; and said conductive pattern further comprises an electrical cable which is received in said recess and which connects electrically said conductive dot and said conductive arc.

10. The data transfer switch as claimed in claim 1, wherein said conductive pattern is formed on said one side of each of said linking pieces and comprises a pair of oppositely projecting conductive arcs.

* * * * *